US005845351A

United States Patent [19]

Berta et al.

[11] Patent Number: 5,845,351

[45] Date of Patent: Dec. 8, 1998

[54] STRETCHER TABLE ASSEMBLY WHICH IS MOUNTED OVER AN AMBULANCE STRETCHER

[75] Inventors: Kenneth R. Berta, Lebanon; Richard C. Habernehl, New Venna, both of Ohio

[73] Assignee: Ferno-Washington, Inc., Wilmington, Ohio

[21] Appl. No.: 852,556

[22] Filed: May 7, 1997

[51] Int. Cl.[6] ..... A61G 1/04

[52] U.S. Cl. ..... 5/626; 5/503.1; 5/507.1; 5/925

[58] Field of Search ..... 5/625–629, 503.1–507.1, 5/658, 691; 108/49; 296/20

[56] References Cited

U.S. PATENT DOCUMENTS

| | | | |
|---|---|---|---|
| 2,201,424 | 5/1940 | Berger | 5/691 |
| 2,724,133 | 11/1955 | Sorrel | 5/691 |
| 3,078,478 | 2/1963 | Sheahan | 108/49 |
| 3,167,790 | 2/1965 | Hickey | 5/507.1 |
| 3,538,521 | 11/1970 | Basner | 5/691 |
| 3,803,645 | 4/1974 | Oliverius | 5/505.1 |
| 4,203,175 | 5/1980 | Heine | 5/503.1 |
| 4,398,707 | 8/1983 | Cloward | 5/632 |
| 4,998,277 | 3/1991 | Rioux, Jr. | 5/503.1 |
| 5,275,170 | 1/1994 | Lewis | 5/503.1 |
| 5,396,846 | 3/1995 | Kelly et al. | 108/91 |
| 5,497,968 | 3/1996 | Hewko | 248/214 |

OTHER PUBLICATIONS

Cot–Mounted Pac–Rac Equipment Table Model 274, 1994 Product Catalog, Ferno, pp. 87 and 88; 5/507.1.

*Primary Examiner*—Alex Grosz
*Attorney, Agent, or Firm*—Killworth, Gottman, Hagan & Schaeff, LLP

[57] ABSTRACT

A stretcher table assembly is provided for attachment over an ambulance stretcher. The stretcher table assembly includes a tray for securing medical equipment used during an emergency. A pair of legs extend away from the tray and include attachment members for engaging the rails of the stretcher. The attachment members may include anti-skidding members providing frictional resistance between the attachment members and the rails. The legs are secured to the rails through a flexible strap. The flexible strap may be wrapped around the rail and secured. The flexible strap may also be used in conjunction with a hook which engages the rail. The flexible strap is then secured to hold the stretcher table assembly in place over the stretcher.

23 Claims, 4 Drawing Sheets

STRETCHER TABLE ASSEMBLY WHICH IS MOUNTED OVER AN AMBULANCE STRETCHER

BACKGROUND OF THE INVENTION

The present invention relates to an apparatus for mounting emergency care equipment to an ambulance stretcher, and more particularly to an apparatus which extends over an ambulance stretcher to provide support for emergency care equipment needed to care for a patient and which allows for transport of such equipment between emergency care vehicles and medical facilities.

A typical ambulance stretcher has a tubular metal frame construction which is generally rectangular in shape with supports for a mattress and a wheeled undercarriage. The mattress frame is supported on the wheeled undercarriage by an arrangement of collapsible legs so that the legs may be collapsed together for transport in an ambulance. The stretcher may include side bars to prevent the patient from rolling off the stretcher during transport.

The typical ambulance stretcher must be relatively compact to fit within an ambulance or transport helicopter and to allow sufficient room for medical personnel to attend to the patient. While most stretchers include various auxiliary fittings for attaching and carrying some emergency equipment, design constraints prevent the inclusion of easily assessable shelves or compartments on the stretcher for the transport of such emergency equipment. Emergency equipment, such as intravenous bags, oxygen tanks, cardiac monitors, defibrillators, and pumps, are commonly used in an emergency situation. This equipment must be transported with the patient and needs to be easily assessable. During an emergency situation, there are normally one or two emergency technicians available for the care and transport of the patient. The technicians are responsible for caring for the patient, transporting the patient, and carrying the emergency equipment, which together strains the capabilities of even the most talented technicians. Previously, technicians were forced to place most of the emergency equipment on the stretcher mattress and commonly on the patient himself. Such an arrangement is disadvantageous because the equipment is relatively inaccessible, is susceptible to interference by the patient, and may contact an injured area on the patient.

Prior art devices have been developed to address the problems associated with transporting emergency equipment with the patient. One prior art device includes a collapsible tray with arms which extend over the patient. Attachment members on the arms engage the rails of the stretcher and rigid clamps on both arms hold the tray in place. The top of the tray is used to secure the emergency equipment. While the emergency equipment is easily assessable and away from the patient, the use of a rigid clamp makes the tray cumbersome to attach to the stretcher. A second prior art device is disclosed in U.S. Pat. No. 5,497,968, issued to Hewko on Mar. 12, 1996. The '968 patent discloses a rigid tray having four legs which extend over the patient. Two of the legs include C-shaped hooks which rest on a rail on a first side of the stretcher. One of the other legs include an L-shaped member which rests on a rail on the second side of the stretcher. The last leg has an inverted U-shaped member which is placed over the rail on the second side of the stretcher. A retaining pin is placed through a pair of holes in the arms of the inverted U so as to trap the inverted U-shaped member to the rail on the second side of the stretcher. The top surface of the tray is also used to secure the emergency equipment. However, while the rigid tray is relatively secure in the vertical direction through three of the four legs, it is free to move in the horizontal direction. Any sudden forces on the rigid tray may cause the tray to translate along the rails pulling the emergency equipment and attachments on the patient with it.

Accordingly, there remains a need for an apparatus which may be easily and securably mounted to an ambulance stretcher and which is adapted to secure emergency equipment used in the care of an injured or ill patient.

SUMMARY OF THE INVENTION

The present invention meets the aforementioned needs by providing a stretcher table assembly which may be easily and securably mounted to an ambulance stretcher and which is adapted to secure emergency equipment used in the care of injured or ill patients.

According to a first aspect of the present invention, the stretcher table assembly includes a substantially planar tray having first and second ends opposing one another. A first leg having first and second ends has the first end coupled to the tray generally adjacent the first end of the tray. The first leg further includes a flexible strap and an attachment member positioned generally adjacent the second end of the first leg. A second leg having first and second ends has the first end coupled to the tray generally adjacent the second end of the tray. The second leg further includes a flexible strap and an attachment member positioned generally adjacent the second end of the second leg.

Preferably, each of the flexible straps of the first and second legs includes a locking member. Preferably, each of the attachment members of each of the first and second legs includes a first attachment member and a second attachment member. One of the first and second attachment members of the first leg may further include an anti-skidding member and one of the first and second attachment members of the second leg may further include an anti-skidding member. The other of the first and second attachment members of the first leg may further include an anti-skidding member and the other of the first and second attachment members of the second leg may further include an anti-skidding member. Preferably, each of the first and second attachment members of each of the first and second legs further includes an opening through which the anti-skidding member is coupled.

According to another aspect of the present invention, the anti-skidding member preferably includes a first portion having a diameter greater than a diameter of the opening, a second portion having a diameter less than the diameter of the opening, and a conically shaped third portion with a base having a diameter greater than the diameter of the opening and a tip having a diameter less than the diameter of opening. The tip of the third portion is passed through the opening and the second portion is positioned within the opening between the first portion and the base of the third portion. Preferably, the anti-skidding member is composed of a material selected from the group consisting of rubber and plastic.

According to yet another aspect of the present invention, each of the locking members of each of the flexible straps includes a ring, and hooks and loops fasteners on respective first and second portions of the flexible strap. The stretcher table assembly is secured to a stretcher by looping the flexible strap around a rail on the stretcher, passing the flexible strap through an inner portion of the ring, and securing the hook fasteners on the first portion of the flexible strap to the loop fasteners on the second portion of the flexible strap.

According to yet another aspect of the present invention, each of the locking members of each of the flexible straps includes a first ring and a second ring. The stretcher table assembly is secured to a stretcher by looping the flexible strap around a rail on the stretcher, passing the flexible strap through an inside portion of the first and second rings, looping the flexible strap over the second ring and passing the flexible strap through the inside portion of the first ring.

According to yet another aspect of the present invention, each of the locking members of each of the flexible straps includes a hook member and an adjuster tab having a first portion and a second portion pivotally coupled to the first portion. The stretcher table assembly is secured to a stretcher by the hook member being positioned around a rail on the stretcher, and looping the flexible strap over the second portion of the adjuster tab and securing the by rotating the second portion of the adjuster tab. Preferably, the second portion of each of the adjuster tabs includes a bar having teeth thereon and a tab portion coupled to the bar forming a slot therein. The flexible strap is looped over the bar and through the slot, such that with the tab in a first position the flexible strap may be adjusted within the slot and with the tab in a second position the teeth engage and secure the flexible strap. Each of the first and second legs may include a slot for slidably engaging the first portion of the adjuster tab.

DETAILED DESCRIPTION OF THE PREFERRED EMBODIMENTS

Figure 1:
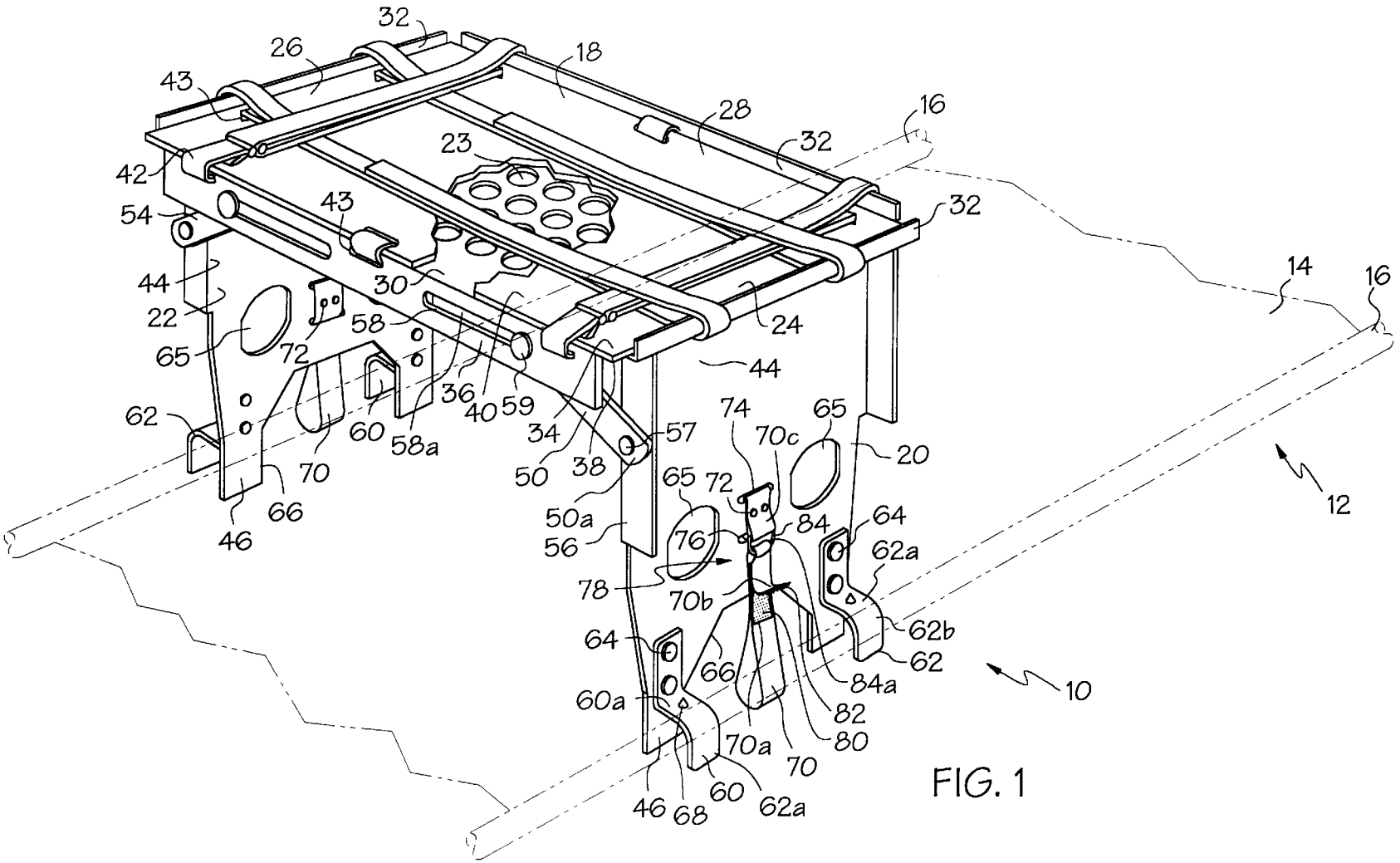
FIG. 1 is a perspective view of a stretcher table assembly, illustrating the flexible strap according to a first embodiment of the present invention.

Referring now to FIG. 1, a stretcher table assembly 10 coupled to a typical ambulance stretcher 12 (shown in phantom lines) is shown. The typical ambulance stretcher 12 includes a mattress 14, rails 16, and a set of collapsible wheels (not shown). Rails 16 are typically constructed of metallic bars. The stretcher table assembly 10 includes a tray 18, a first leg 20 and a second leg 22.

The tray 18 is substantially planar and includes a plurality of cutouts 23 to reduce the overall weight of the stretcher table assembly 10. The tray 18 is generally rectangular in shape having a first end 24 opposing a second end 26 and a third end 28 opposing a fourth end 30. Each of the first, second, and third ends 24, 26, 28 include an integral shoulder 32 which extends above a top surface 34 of the tray 18. The fourth end 30 includes an integral mounting bracket 36 which extends below a bottom surface 38 of the tray 18. A mat 40 is placed on top surface 34 with a plurality of straps 42 which are placed through a plurality of corresponding slots 43 generally adjacent the first, second, third and fourth sides of tray 18 and on mounting bracket 36. Emergency equipment is secured to the top surface 34 of tray 18 by straps 42. Preferably, the straps 42 are adjustable to accommodate various types of emergency equipment. The straps 42 may be elastic or flexible with any conventional strap fastening means, such as hook and loop fasteners, rings, clasps, and buckles. The shoulders 32 help keep the equipment from translating off the top surface 34.

The first and second legs 20, 22 each include a first end 44 and a second end 46. The first end 44 of the first leg 20 is coupled to the bottom surface 38 of the tray 18 generally adjacent said first end 24 through a first hinge (not shown) and a first bracket 50. Similarly, the first end 44 of the second leg 22 is coupled to the bottom surface 38 of the tray 18 generally adjacent said second end 26 through a second hinge (not shown) and a second bracket 54. The first and second legs 20, 22 are mounted to the tray 18 in the same manner so the description will be limited to the mounting of the first leg 20. A first portion of the first hinge is coupled to the bottom surface 38 of tray 18 generally adjacent the first end 24 using conventional fasteners (not shown). A second portion of the first hinge 48 is coupled to the first leg 20 generally adjacent the first end 44 using conventional fasteners (not shown). A first end 50*a* of bracket 50 is coupled to a shoulder portion 56 of first leg 20 using conventional fastener 57. A second end of bracket 50 is coupled to a slot 58 on mounting bracket 36 of tray 18 using fastener 59. The slot 58 is keyhole shaped with a first oblong portion 58*a* and a second circular portion (not shown) having a diameter greater than a vertical length of the first oblong portion 58*a*. Fastener 59 includes a first portion (not shown) having a diameter slightly less than the diameter of the second circular portion but greater than the vertical length of the first oblong portion 58*a* and a second portion (not shown) having a diameter slightly less than the vertical length of the first oblong portion 58*a*. The second end of bracket 50 is able to translate back and forth through slot 58 when the second portion of fastener 59 is positioned anywhere within slot 58. The second end of bracket 50 is locked in place when the first portion of fastener 59 is positioned within second circular portion of slot 58. The second end of bracket 50 is maintained within second circular portion of slot 58 through a spring (not shown) between the first and second portions of fastener 59. Since the diameter of the first portion of the fastener 59 is greater than the vertical length of the first oblong portion 58*a* of slot 58, the second end of bracket 50 is locked in place until a sufficient amount of force is applied to the bracket 50 to counter the force of the spring and dislodge the first portion of the fastener 59 from the second circular portion of the slot 58.

The bracket 50, the slot 58 and the first leg 20 are arranged so that the second end of the bracket 50 is locked in place when the first leg 20 is substantially perpendicular to the bottom surface 38 of tray 18. It should be apparent that the first leg 20 is also locked in place when the second end of the bracket 50 is locked in place. The first leg 20 is in an open position when it is locked in place by bracket 50. The first leg 20 pivots about the first hinge and is in a closed position when it is substantially parallel to the bottom surface 38 of tray 18. The stretcher table assembly 10 is relatively compact with both legs 20, 22 in the closed position for ease of storage. It will be appreciated by those skilled in the art that the legs 20, 22 may be rigidly coupled to the tray 18 without departing from the scope of the present invention. It will be further appreciated by those skilled in the art that other means may be used to couple the legs 20, 22 to the tray 18 without departing from the scope of the present invention.

The first and second legs 20, 22 each include a first attachment member 60 and a second attachment member 62 positioned generally adjacent the second end 46. The first and second attachment members 60, 62 are preferably spaced near the opposite sides of the second end 46. The first and second attachment members 60, 62 are generally L-shaped with a first portion 60*a*, 62*a* extending generally perpendicular from respective legs 20, 22 and a second portion 60*b*, 62*b* extending generally parallel with respect to respective legs 20, 22. The first and second attachment members 60, 62 are coupled to the first and second legs 20, 22 using conventional fasteners 64. The first and second attachment members 60, 62 may extend outward or inward from respective legs 20, 22 depending on the width of the ambulance stretcher 12 and rails 16. While the attachment members 60, 62 have been shown as separate and distinct components, it will be appreciated by those skilled in the art that the attachment members 60, 62 may be formed integrally with the legs 20, 22 without departing from the scope of the invention. It will be further appreciated by those skilled in the art that a single attachment member may be used without departing from the scope of the present invention. Preferably, each of the first and second legs 20, 22 include a pair of cutouts 65 to receive attachment members 60, 62 of the opposite leg when the legs 20, 22 are in the closed position. Further, each of the first and second legs 20, 22 preferably include a cutout 66 between first and second attachment members 60, 62 to reduce the weight of the stretcher table assembly 10 and to serve as handles when positioning the stretcher table assembly 10 onto the stretcher 12. Preferably, the tray 18 and legs 20, 22 are composed of sturdy, light weight material, such as aluminum, stainless steel or titanium. As will be appreciated by those skilled in the art, the tray 18 and legs 20, 22 may also be composed of a suitable plastic or plastic reinforced composite material.

Figure 5:
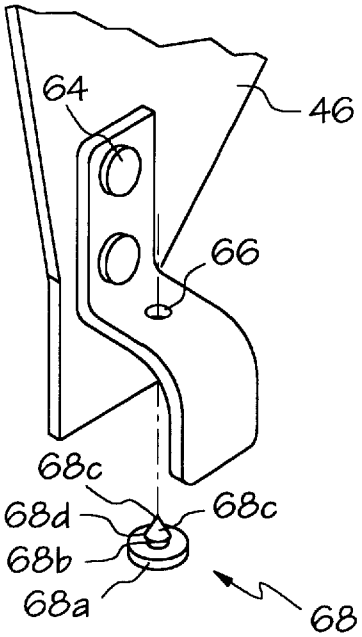
FIG. 5 is an enlarged exploded perspective view of one of the attachment members, illustrating the anti-skidding member of the present invention.

As shown in FIG. 5, each of the attachment members 60, 62 include an opening 66 along first portion 60*a*, 62*a* for receiving anti-skidding member 68. Preferably, anti-skidding member 68 includes a first circular portion 68*a* having a diameter larger than a diameter of opening 66, a second circular portion 68*b* having a diameter less than the diameter of opening 66, and a conically shaped third portion 68*c* with a base portion 68*d* having a diameter greater than the diameter of opening 66 and a tip portion 68*e* having a diameter less than the diameter of opening 66. The tip portion 68*e* is passed through opening 66 so that the first circular portion 68*a* rests on the bottom of attachment member 60, 62 and the base portion 68*d* rests on the top of attachment member 60, 62. The second circular portion 68*b* is positioned within opening 66 such that the anti-skidding member 68 is held securely in place by the first circular portion 68*a* and base portion 68*d*. Anti-skidding member 68 provides an increased coefficient of friction between the attachment members 60, 62 and the rails 16 when the stretcher table assembly 10 is in its operating position as shown in FIG. 1. Anti-skidding member 68 also increased the static coefficient of friction in the horizontal direction along rails 16 when the legs 20, 22 are secured to the rails 16. Preferably, anti-skidding member 68 is composed of a material selected from the group consisting of rubber and plastic. Certain rubbers and plastics provide increased frictional resistance to relative movement when placed between separate metallic materials. As will be appreciated by those skilled in the art, other materials which provide increased friction between metallic materials may be used. It will be further appreciated by those skilled in the art that the anti-skidding member 68 may be coupled to the attachment members 60, 62 using other means, such as fasteners or adhesives. It will be even further appreciated by those skilled in the art that the anti-skidding member 68 may have any suitable shape and configuration without departing from the scope of the present invention.

The first and second legs 20, 22 are secured to the rails 16 through flexible straps 70. According to a first embodiment of the present invention, flexible straps 70 are secured to the legs 20, 22 by conventional fasteners 72. Preferably, legs 20, 22 include a pair of slots 74, 76 for receiving the flexible straps 70. The flexible strap 70 is passed through the top slot 74 and then through the bottom slot 76. Preferably, the flexible straps 70 are composed of reinforced fibers similar to those used for standard seat belts. Each flexible strap 70 includes a locking member 78. Locking member 78 includes hook fasteners 80 coupled to a first portion 70*a* of flexible strap 70, loop fasteners 82 coupled to a second portion 70*b* of flexible strap 70, and a ring 84 coupled to a third portion 70*c* of flexible strap 80. Ring 84 is preferably D-shaped with an inner portion 84*a*. The stretcher table assembly 10 is placed over the stretcher 12 so that attachment members 60, 62 engage rails 16. The flexible strap 70 is looped around a respective rail 16, passed through the inner portion 84*a* of ring 84 and the first portion 70*a* of flexible strap 70 is fastened to the second portion 70*b* of flexible strap 70 through hook and loop fasteners 82, 84. The flexible strap 70 is pulled taut so that it is firmly secured around the rail 16. Anti-skidding member 68 is also compressed between the rails 16 and the hook members 60, 62 providing frictional resistance along the surface of the rails 16. With the flexible straps 70 on legs 20, 22 secured to the rails 16 as described above, the stretcher table assembly 10 is securely fastened to the stretcher 12. The flexible straps 70 keep the stretcher table assembly 10 firmly secured along the vertical direction and in combination with the anti-skidding member 68 firmly secured in the horizontal direction. The stretcher table assembly 10 may withstand the forces associated with ordinary movement of the stretcher 12 as well as sudden forces which may be imparted during sudden braking of an ambulance or an accident. Further, the stretcher table assembly 10 may be easily attached, adjusted and removed through the ring 84, hook fasteners 80 and loop fasteners 82. Preferably, the hook and loop fasteners 80, 82 are commercially available from Endisco Supply Company under the trademark, Velcro®.

Figure 2:
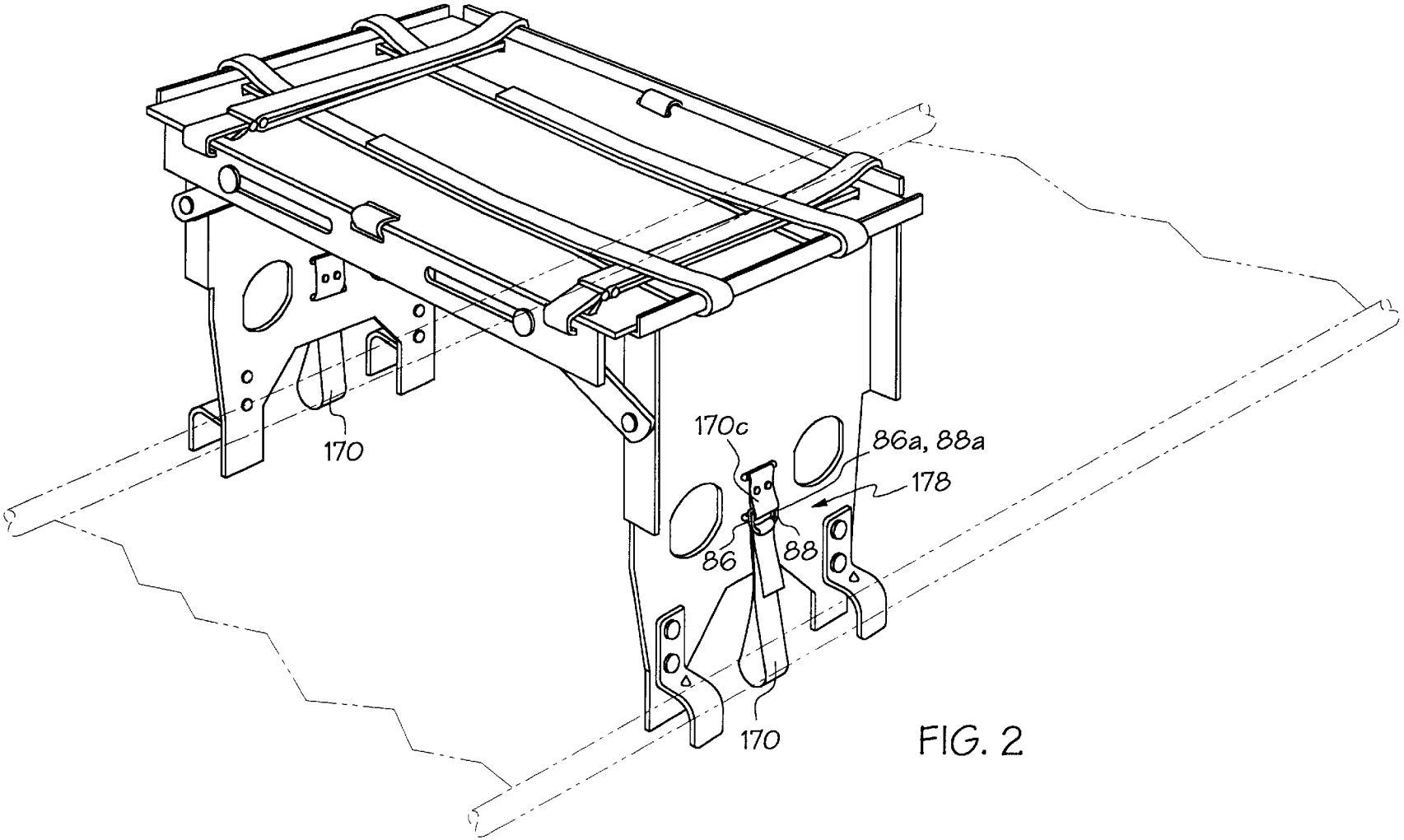
FIG. 2 is a perspective view of the stretcher table assembly, illustrating the flexible strap according to a second embodiment of the present invention.

The second embodiment of the present invention is illustrated in FIG. 2. The second embodiment includes a flexible strap 170 coupled to the legs 20, 22 as described above with respect to the first embodiment and a new locking member 178. Locking member 178 includes a first ring 86 and a second ring 88. Preferably, the first ring 86 and second ring 88 are D-shaped having inner portions 86*a*, 88*b*. The first and second rings 86, 88 are preferably coupled to a third portion 170*c* of flexible strap 170. The flexible strap 170 is again looped over a respective rail 16 and passed through the inner portions 86*a*, 88*b* of the first and second rings 86, 88. The flexible strap 170 is then looped over the second ring 88 and passed through the inner portion 86*a* of the first ring 86. The flexible strap 170 is pulled taut, firmly securing each respective leg to the rails 16 of stretcher 12. With the flexible straps 170 on legs 20, 22 secured to the rails 16 as described above, the stretcher table assembly 10 is securely fastened to the stretcher 12. As with the first embodiment, the stretcher table assembly 10 may withstand the forces associated with ordinary movement of the stretcher 12 as well as sudden forces which may be imparted during sudden braking of an ambulance or an accident. Further, the stretcher table assembly 10 may be easily attached, adjusted and removed by manipulating the flexible strap 170 and rings 86, 88.

Figure 3:
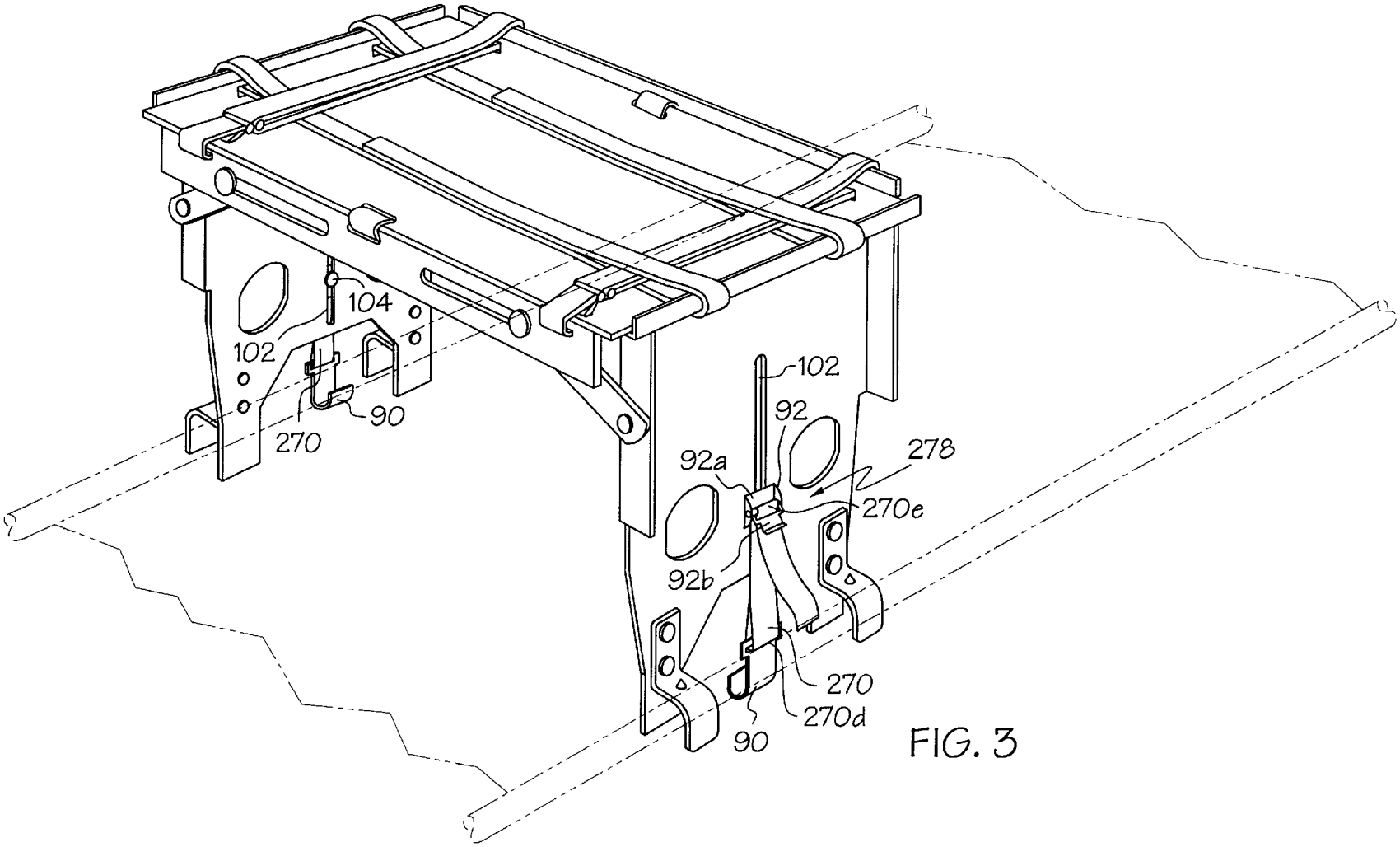
FIG. 3 is a perspective view of the stretcher table assembly, illustrating the flexible strap according to a third embodiment of the present invention.
Figure 4:
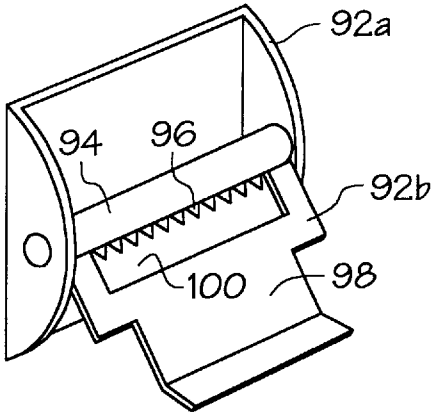
FIG. 4 is an enlarged perspective view of the adjuster tab illustrated in FIG. 3.

The third embodiment of the present invention is illustrated in FIG. 3. The third embodiment includes a flexible strap 270 and locking member 278 which are coupled to each of the legs 20, 22 as described below. Locking member 278 includes a hook member 90 and an adjuster tab 92 having a first portion 92*a* and a second portion 92*b* pivotally coupled to first portion 92*a*. As shown in FIG. 4, second portion 92*b* preferably includes a bar 94 having teeth 96 thereon and a tab portion 98 coupled to bar 94 forming a slot 100 therein. First and second legs 20, 22 include a slot 102 for slidably engaging the first portion 92*a* of adjuster tab 92. The first portion 92*a* includes a button 104 which extends over slot 102. The hook member 90 is coupled to a first end 270*d* of flexible strap 270. A second end 270*e* of flexible strap 270 is looped over bar 94 and passed through slot 100 of adjuster tab 92. The flexible strap 270 may be adjusted within adjuster tab 92 when the tab portion 98 is in a first position as teeth 96 do not engage the flexible strap 270. The flexible strap 270 is secured within the adjuster tab 92 when the tab portion 98 is in a second position as the teeth 96 engage the flexible strap 270 and prevent movement of same. As shown in FIG. 3, the hook member 90 is positioned around the respective rail 16 and with the tab portion 98 in the first position, the flexible strap 270 is pulled through slot 100. Once the flexible strap 270 is tight, the tab portion 98 is moved to the second position, locking the flexible strap 270 in place. Once both flexible straps 270 are in place as described above, the stretcher table assembly 10 is securely fastened to the stretcher 12. As with the first and second embodiments, the stretcher table assembly 10 may withstand the forces associated with ordinary movement of the stretcher 12 as well as sudden forces which may be imparted during sudden braking of an ambulance or an accident. Further, the stretcher table assembly 10 may be easily attached, adjusted and removed by moving the tab portion 98 and manipulating the flexible strap 270. It will be appreciated by those skilled in the art that the flexible strap 70, 170, 270 may be easily tied to the rails thereby eliminating the need for the locking member 78, 178, 278. It will be further appreciated by those skilled in the art that other types of locking members may be used without departing from the scope of the present invention.

Having described the invention in detail and by reference to preferred embodiments thereof, it will be apparent that modifications and variations are possible without departing from the scope of the invention which is defined in the appended claims.

What is claimed is:

1. A stretcher table assembly comprising:

a substantially planar tray having first and second ends opposing one another;

a first leg having first and second ends, said first end coupled to said tray generally adjacent said first end of said tray, said first leg further comprising an attachment member positioned generally adjacent said second end of said first leg and a flexible strap adapted to be releasably and securely attached to a rail of a stretcher by looping said flexible strap of said first leg around said rail; and a second leg having first and second ends, said first end coupled to said tray generally adjacent said second end of said tray, said second leg further comprising a attachment member positioned generally adjacent said second end of said second leg and a flexible strap adapted to be releasably and securely attached to another rail of said stretcher by looping said flexible strap of said second leg around said another rail.

2. The assembly of claim 1, wherein each of said attachment members of each of said first and second legs comprises a first attachment member and a second attachment member.

3. The assembly of claim 2, wherein one of said first and second attachment members of said first leg further comprises an anti-skidding member and one of said first and second attachment members of said second leg further comprises an anti-skidding member.

4. The assembly of claim 3, wherein the other of said first and second attachment members of said first leg further comprises an anti-skidding member and the other of said first and second attachment members of said second leg further comprises an anti-skidding member.

5. The assembly of claim 4, wherein each of said first and second attachment members of each of said first and second legs further comprises an opening through which said anti-skidding member is coupled.

6. The assembly of claim 5, wherein said anti-skidding member comprises a first portion having a diameter greater than a diameter of said opening, a second portion having a diameter less than said diameter of said opening, and a conically shaped third portion with a base having a diameter greater than said diameter of said opening and a tip having a diameter less than said diameter of opening, such that said tip of said third portion is passed through said opening and said second portion is within said opening between said first portion and said base of said third portion.

7. The assembly of claim 6, wherein said anti-skidding member is composed of a material selected from the group consisting of rubber and plastic.

8. The assembly of claim 1, wherein each of said flexible straps of each of said first and second legs further comprises a locking member.

9. The assembly of claim 8, wherein each of said locking members of each of said flexible straps comprises a ring, and hooks and loops fasteners on respective first and second portions of each of said flexible straps, said assembly being secured to said stretcher by looping said flexible straps around respective rails on said stretcher, passing said flexible straps through an inner portion of said respective rings, and securing said hook fasteners on said first portion of said flexible straps to said respective loop fasteners on said second portion of said flexible straps.

10. The assembly of claim 8, wherein each of said locking members of each of said flexible straps comprises a first ring and a second ring, such that said assembly is secured to said stretcher by looping said flexible straps around respective rails on said stretcher, passing said flexible straps through an inside portion of said respective first and second rings, looping said flexible straps over said respective second rings and passing said flexible straps through said inside portion of said respective first rings.

11. The assembly of claim 8, wherein each of said locking members of each of said flexible straps comprises a ring, and loops and hooks fasteners on respective first and second portions of each of said flexible straps, said assembly being secured to said stretcher by looping said flexible straps around respective rails on said stretcher, passing said flexible straps through an inner portion of said respective rings, and securing said loop fasteners on said first portion of said flexible straps to said respective hook fasteners on said second portion of said flexible straps.

12. A stretcher table assembly comprising:

a substantially planar tray having first and second ends opposing one another;

a first leg having first and second ends, said first end coupled to said tray generally adjacent said first end of said tray, said first leg further comprising an attachment member positioned generally adjacent said second end of said first leg and a flexible strap having a locking member, said flexible strap of said first leg adapted to be releasably and securely attached to a rail of a stretcher by looping said flexible strap of said first leg around said rail, wherein said attachment member further comprises an anti-skidding member providing friction between said rail of said stretcher and said attachment member of said first leg; and a second leg having first and second ends coupled to said tray generally adjacent said second end of said tray, said second leg further comprising an attachment member positioned generally adjacent said second end of said second leg and a flexible strap having a locking member, said flexible strap of said second leg adapted to be releasably and securely attached to another rail of said stretcher by looping said flexible strap of said second leg around said another rail, wherein said attachment member further comprises an anti-skidding member providing friction between said another rail of said stretcher and said attachment member of said second leg.

13. The assembly of claim 12, wherein each of said locking members of each of said flexible straps comprise a ring, and hooks and loops fasteners on respective first and second portions of each of said flexible straps, said assembly being secured to said stretcher by looping said flexible straps around respective rails on said stretcher, passing said flexible straps through an inner portion of said respective rings, and securing said hook fasteners on said first portion of said flexible straps to said respective loop fasteners on said second portion of said flexible straps.

14. The assembly of claim 12, wherein each of said locking members of each of said flexible straps comprises a first ring and a second ring, such that said assembly is secured to said stretcher by looping said flexible straps around respective rails on said stretcher, passing said flexible straps through an inside portion of said respective first and second rings, looping said flexible straps over said respective second rings and passing said flexible straps through said inside portion of said respective first rings.

15. The assembly of claim 12, wherein each of said locking members of each of said flexible straps comprises a ring, and loops and hooks fasteners on respective first and second portions of each of said flexible straps, said assembly being secured to said stretcher by looping said flexible straps around respective rails on said stretcher, passing said flexible straps through an inner portion of said respective rings, and securing said loop fasteners on said first portion of said flexible straps to said respective hook fasteners on said second portion of said flexible straps.

16. A stretcher table assembly comprising:

a substantially planar tray having first and second ends opposing one another;

a first leg having first and second ends, said first end coupled to said tray generally adjacent said first end of said tray, said first leg further comprising first and second attachment members positioned generally adjacent said second end of said first leg, and a flexible strap having a locking member, said flexible strap of said first leg adapted to be releasably and securely attached to a rail of a stretcher by looping said flexible strap of said first leg around said rail, wherein each of said first and second attachment members of said first leg further comprises an anti-skidding member providing friction between said rail of said stretcher and said attachment member of said first leg; and a second leg having first and second ends, said first end coupled to said tray generally adjacent said second end of said tray, said second leg further comprising first and second attachment members generally adjacent said second end of said second leg and a flexible strap having a locking member, said flexible strap of said second leg adapted to be releasably and securely attached to another rail of said stretcher by looping said flexible strap of said second leg around said another rail, wherein each of said first and second attachment members of said second leg further comprises an anti-skidding member providing friction between said another rail of said stretcher and said attachment member of said second leg.

17. A stretcher table assembly comprising:

a substantially planar tray having first and second ends opposing one another;

a first leg having first and second ends, said first end coupled to said tray generally adjacent said first end of said tray, said first leg further comprising an attachment member positioned generally adjacent said second end of said first leg and a flexible strap having a locking member, said locking member comprising a hook member and an adjuster tab having a first portion and a second portion pivotally coupled to said first portion; and a second leg having first and second ends, said first end coupled to said tray generally adjacent said second end of said tray, said second leg further comprising a attachment member positioned generally adjacent said second end of said second leg and a flexible strap having a locking member, said locking member comprising a hook member and an adjuster tab having a first portion and a second portion pivotally coupled to said first portion;

wherein said assembly is secured to a stretcher by positioning each of said hook members around respective rails on said stretcher, and looping said flexible straps over said respective second portions of said adjuster tabs and securing said flexible straps by rotating said respective second portions of said adjuster tabs.

18. The assembly of claim 17, wherein said second portion of each of said adjuster tabs comprises a bar having teeth thereon and a tab portion coupled to said bar forming a slot therein, said flexible straps being looped over said respective bars and through said respective slots, such that with said tabs in a first position said flexible straps may be adjusted within said respective slots and with said tabs in a second position said respective teeth engage and secure said flexible straps.

19. The assembly of claim 18, wherein each of said first and second legs comprises a slot for slidably engaging said first portion of said respective adjuster tabs.

20. A stretcher table assembly comprising:

a substantially planar tray having first and second ends opposing one another;

a first leg having first and second ends, said first end coupled to said tray generally adjacent said first end of said tray, said first leg further comprising an attachment member positioned generally adjacent said second end of said first leg and a flexible strap having a locking member, said locking member comprising a hook member and an adjuster tab having a first portion and a second portion pivotally coupled to said first portion, wherein said attachment member further comprises an anti-skidding member providing friction between said rail of said stretcher and said attachment member of said first leg; and a second leg having first and second ends coupled to said tray generally adjacent said second end of said tray, said second leg further comprising an attachment member positioned generally adjacent said second end of said second leg and a flexible strap having a locking member, said locking member comprising a hook member and an adjuster tab having a first portion and a second portion pivotally coupled to said first portion; wherein said attachment member further comprises an anti-skidding member providing friction between said another rail of said stretcher and said attachment member of said second leg;

wherein said assembly is secured to a stretcher by positioning each of said hook members around respective rails on said stretcher, and looping said flexible straps over said respective second portions of said adjuster tabs and securing said flexible straps by rotating said respective second portions of said adjuster tabs.

21. The assembly of claim 20, wherein said second portion of each of said adjuster tabs comprises a bar having teeth thereon and a tab portion coupled to said bar forming a slot therein, said flexible straps being looped over said respective bars and through said respective slots, such that with said tabs in a first position said flexible straps may be adjusted within said respective slots and with said tabs in a second position said respective teeth engage and secure said flexible straps.

22. The assembly of claim 21, wherein each of said first and second legs comprises a slot for slidably engaging said first portion of said respective adjuster tabs.

23. A stretcher assembly comprising:

a stretcher comprising a mattress, a rail and another rail; and a stretcher table assembly comprising:

a substantially planar tray having first and second ends opposing one another;

a first leg having first and second ends, said first end coupled to said tray generally adjacent said first end of said tray, said first leg further comprising an attachment member positioned generally adjacent said second end of said first leg and a flexible strap adapted to be releasably and securely attached to said rail of said stretcher by looping said flexible strap of said first leg around said rail; and a second leg having first and second ends, said first end coupled to said tray generally adjacent said second end of said tray, said second leg further comprising a attachment member positioned generally adjacent said second end of said second leg and a flexible strap adapted to be releasably and securely attached to said another rail of said stretcher by looping said flexible strap of said second leg around said another rail.

* * * * *